US007654764B2

(12) United States Patent
To

(10) Patent No.: US 7,654,764 B2
(45) Date of Patent: Feb. 2, 2010

(54) RING BINDER MECHANISM HAVING BLOCKING DEVICE

(75) Inventor: Chun On To, Hong Kong (CN)

(73) Assignee: World Wide Stationery Mfg. Co. Ltd., Hong Kong (CN)

( * ) Notice: Subject to any disclaimer, the term of this patent is extended or adjusted under 35 U.S.C. 154(b) by 209 days.

(21) Appl. No.: 11/749,290

(22) Filed: May 16, 2007

(65) Prior Publication Data

US 2008/0286035 A1 Nov. 20, 2008

(51) Int. Cl.
*B42F 13/20* (2006.01)

(52) U.S. Cl. ..... 402/31; 402/39; 402/26

(58) Field of Classification Search ..... 402/3, 402/26–45, 70, 73, 80 R; D19/26, 27, 32
See application file for complete search history.

(56) References Cited

U.S. PATENT DOCUMENTS

| | | | | |
|---|---|---|---|---|
| 2,791,220 | A * | 5/1957 | McBee | 402/44 |
| 2,950,719 | A * | 8/1960 | Lyon | 402/38 |
| 4,434,534 | A * | 3/1984 | Handler | 24/67.1 |
| 5,180,247 | A * | 1/1993 | Yu | 402/41 |
| 5,718,529 | A | 2/1998 | Chan | |
| 5,967,690 | A * | 10/1999 | Tibbetts | 402/73 |
| 5,975,785 | A * | 11/1999 | Chan | 402/36 |
| 6,116,804 | A * | 9/2000 | Mehta | 402/38 |
| 6,206,601 | B1 * | 3/2001 | Ko | 402/38 |
| 7,270,496 | B2 * | 9/2007 | Morgan et al. | 402/38 |
| 2003/0103796 | A1 * | 6/2003 | To et al. | 402/38 |
| 2006/0251467 | A1 * | 11/2006 | Cheng | 402/19 |
| 2007/0086836 | A1 * | 4/2007 | Cheng | 402/37 |

FOREIGN PATENT DOCUMENTS

| | | | |
|---|---|---|---|
| GB | 868724 | * | 5/1961 |
| GB | 1561955 | | 3/1980 |
| JP | 05016588 A | * | 1/1993 |

OTHER PUBLICATIONS

Koloman Handler ring mechanism, 9 photos (admitted prior art).
Standard—XR (SXR) product specification sheet printed from www.ring-alliance.com; Ring Alliance Ringbuchtechnik GmbH, Austria, 1 pg (admitted prior art).

* cited by examiner

*Primary Examiner*—Dana Ross
*Assistant Examiner*—Jamila Williams
(74) *Attorney, Agent, or Firm*—Senninger Powers LLP

(57) ABSTRACT

A ring binder includes a housing, a driving mechanism moveable relative to the housing, and rings for holding the loose-leaf pages. Each ring has a first ring member and a second ring member moveable relative to each other between a closed position and an opened position. A ring actuator is positionable relative to the housing and operatively connected to the driving mechanism for moving the ring members between their closed and opened positions. A blocking device blocks the ring members in their closed position against movement to their opened position. The blocking device is positionable relative to the housing between a blocking position wherein the ring members are inhibited by the blocking device against movement from their opened position, and an unblocking position wherein the ring members are selectively moveable from their closed position to their opened position by positioning of the actuator. The blocking device is operable independent of the actuator.

17 Claims, 12 Drawing Sheets

RING BINDER MECHANISM HAVING BLOCKING DEVICE

FIELD OF THE INVENTION

This invention relates to ring binder mechanisms for retaining loose-leaf pages, and in particular to a ring binder mechanism having a blocking device for inhibiting unintended opening of the ring binder mechanism.

BACKGROUND

A ring binder mechanism includes ring members for retaining loose-leaf pages, such as hole-punched pages, in a file or notebook. The ring members may be selectively opened to add or remove pages or closed to retain pages while allowing the pages to be moved along the ring members. Typically, the ring members mount on two adjacent hinge plates that join together about a pivot axis. An elongate housing loosely supports the hinge plates within the housing and holds the hinge plates together so they may pivot relative to the housing.

The undeformed housing is slightly narrower than the joined hinge plates when the hinge plates are in a coplanar position (180°). As the hinge plates pivot through this position, they deform the resilient housing and cause a spring force in the housing that urges the hinge plates to pivot away from the coplanar position, either opening or closing the ring members. Thus, when the ring members are closed the spring force resists hinge plate movement and clamps the ring members together. Similarly, when the ring members are open, the spring force holds them apart. An operator may overcome this force by manually pulling the ring members apart or pushing them together. Levers can also be provided on one or both ends of the housing for actuating the ring members between the open and closed positions.

A drawback to typical ring binder mechanism configurations is that when the ring members are closed, they do not inhibit unintended separating of the ring members, such as if the mechanism is accidentally dropped. There is a need, therefore, for a blocking device that is capable of blocking all of the ring members of a ring binder mechanism closed that is inexpensive to manufacture, simple to construct, easy to use, and reliable in repeated operation.

SUMMARY OF THE INVENTION

In one aspect, a ring binder mechanism for holding loose-leaf pages generally comprises a housing, a driving mechanism supported by the housing for movement relative to the housing, and rings for holding the loose-leaf pages. Each ring includes a first ring member and a second ring member. The first ring member is operatively connected to the driving mechanism for movement relative to the second ring member between a closed position and an opened position of the ring members. In the closed position, the two ring members form a substantially continuous, closed loop for allowing loose-leaf pages retained by the rings to be moved along the rings from one ring member to the other. In the opened position, the two ring members form a discontinuous, open loop for adding or removing loose-leaf pages from the rings. A ring actuator is positionable relative to the housing and operatively connected to the driving mechanism for moving the ring members between their closed and opened positions. A blocking device blocks the ring members in their closed position against movement to their opened position. The blocking device is positionable relative to the housing between a blocking position wherein the ring members are inhibited by the blocking device against movement from their opened position and an unblocking position wherein the ring members are selectively moveable from their closed position to their opened position by positioning of the actuator. The blocking device is operable independent of the actuator.

In another aspect, a ring binder mechanism for holding loose-leaf pages generally comprises a housing, a driving mechanism supported by the housing for movement relative to the housing, and rings for holding the loose-leaf pages. Each ring includes a first ring member and a second ring member. The first ring member is mounted on the driving mechanism for movement relative to the second ring member between a closed position and an opened position of the ring members. In the closed position, the two ring members form a substantially continuous, closed loop for allowing loose-leaf pages retained by the rings to be moved along the rings from one ring member to the other. In the opened position, the two ring members form a discontinuous, open loop for adding or removing loose-leaf pages from the rings. First and second blocking structures inhibit the ring members against movement from their closed position to their opened position. Each of the blocking members are moveable relative to the housing and independent of each other between a blocking position wherein each of the ring members are inhibited from movement toward their opened position and an unblocking position wherein the ring members can be selectively moved from their closed position to their opened position.

Other features of the invention will be in part apparent and in part pointed out hereinafter.

BRIEF DESCRIPTION OF THE DRAWINGS

Corresponding reference numbers indicate corresponding parts throughout the views of the drawings.

DETAILED DESCRIPTION

Figure 1:
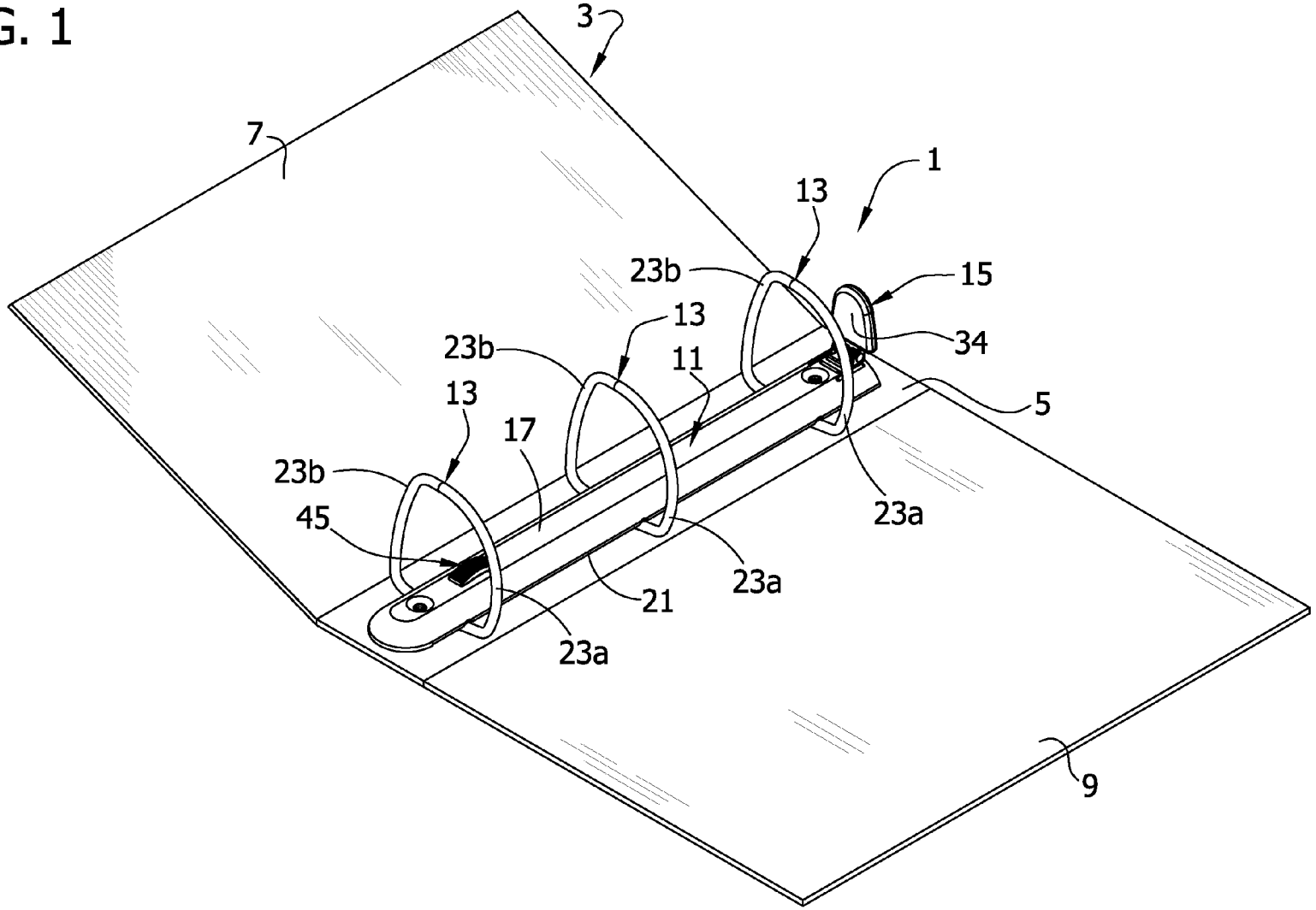
FIG. 1 is a perspective of a notebook incorporating a ring binder mechanism.

Referring now to the drawings, FIG. 1 illustrates a ring binder mechanism, indicated generally at 1, mounted on a notebook, which is designated generally at 3. More specifically, the mechanism 1 is illustrated mounted on a spine 5 of the notebook 3 between a front cover 7 and a back cover 9 hingedly attached to the spine 5. The front and back covers 7, 9 move to selectively cover or expose loose-leaf pages (not shown) retained by the mechanism 1 in the notebook 3. Ring binder mechanisms mounted on notebooks in other ways or on surfaces other than a notebook, for example, a file, do not depart from the scope of this invention.

As illustrated in FIGS. 1-4, the ring binder mechanism 1 comprises a housing, designated generally at 11, three rings (each designated generally at 13) supported by the housing, and a lever (also broadly referred to as a "ring actuator" and designated generally at 15) mounted adjacent an end of the housing. The rings 13 retain loose-leaf pages on the ring binder mechanism 1 in the notebook 3 while the lever 15 operates to open and close the rings so that pages may be added or removed.

Figure 3:
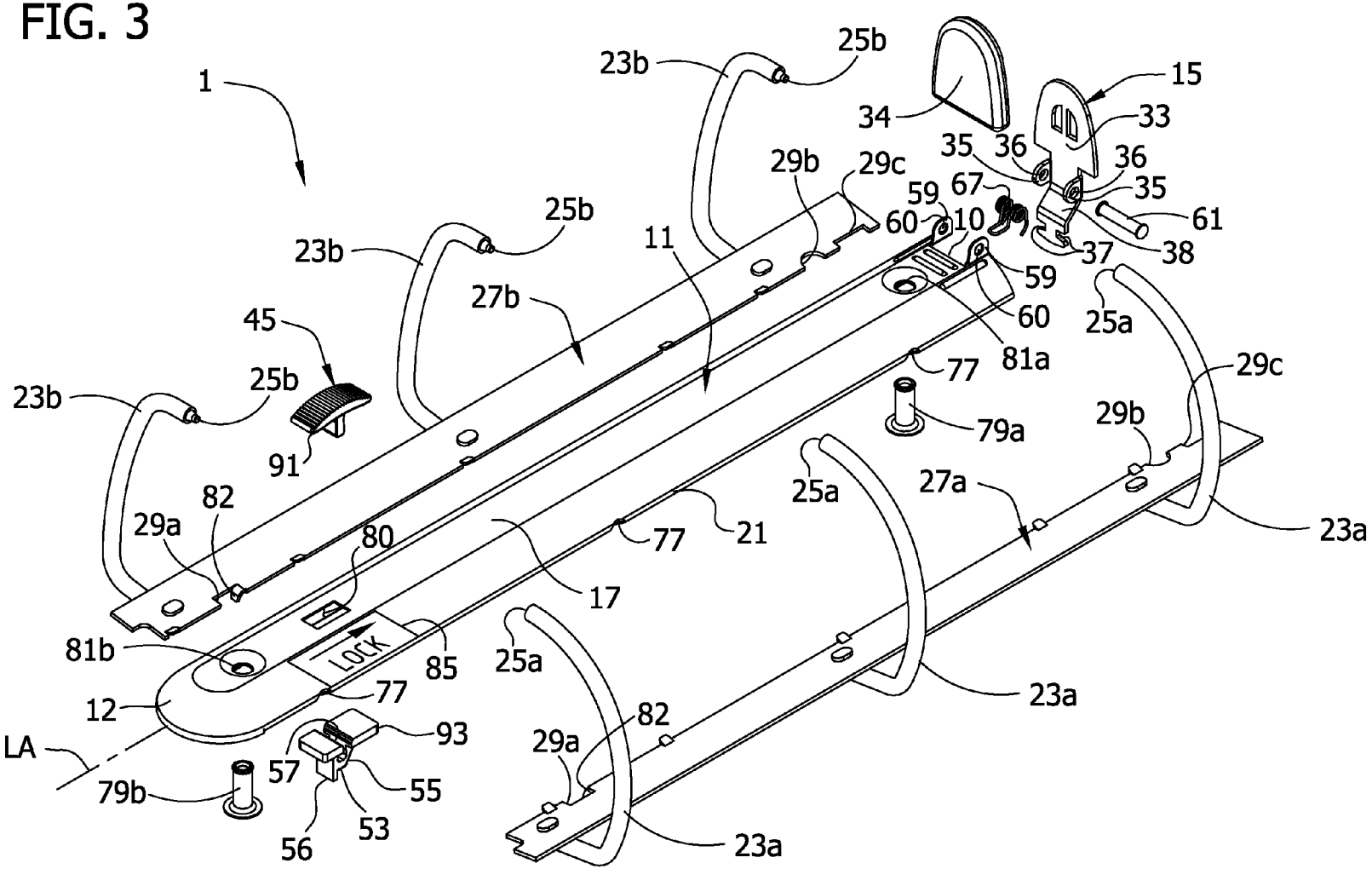
FIG. 3 is an exploded perspective thereof.

The housing 11 is shaped as an elongate rectangle with a uniform, roughly arch-shaped cross section, having at its center a generally flat plateau 17. As illustrated in FIG. 3, the plateau 17 includes a generally rectangular aperture 80 and two circular openings 81*a*, 81*b*. A first longitudinal end 10 of the housing 11 (to the right in FIG. 3) is generally open while a second, opposite longitudinal end 12 is generally closed (to the left in FIG. 3). The housing 11 includes a pair of spaced mounting tabs 59 having openings 60 therein located adjacent its first longitudinal end 10. Bent under rims 21 (FIG. 4) extend lengthwise along longitudinal edges of the housing 11 from the first longitudinal end 10 of the housing to the second longitudinal end 12. Each of the bent under rims 21 includes three spaced-apart cutouts 77. Mechanisms having housings of other shapes, including irregular shapes, or housings that are integral with a file or notebook do not depart from the scope of this invention.

Figure 2:
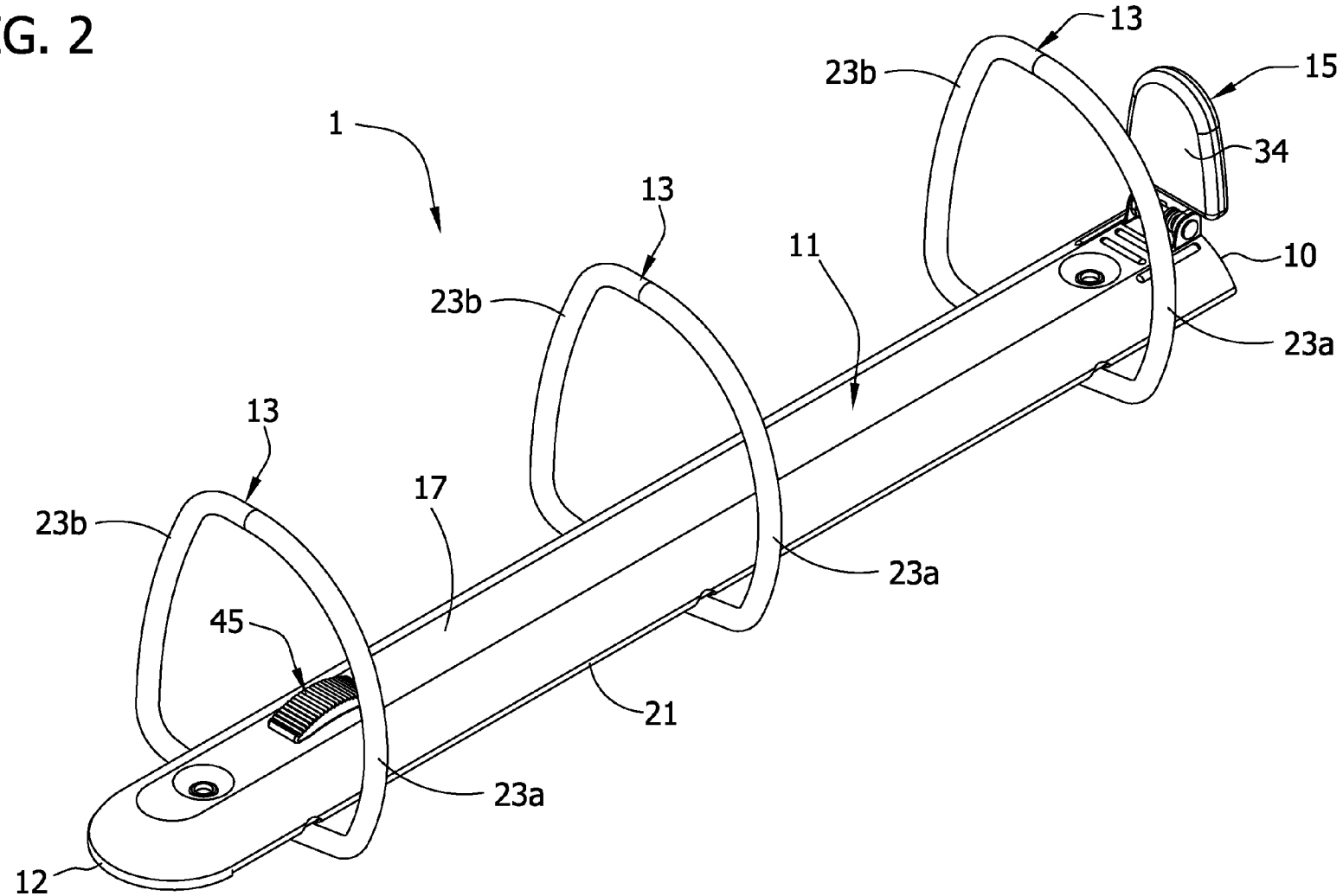
FIG. 2 is a top side perspective of the ring binder mechanism at a closed and blocked position.

The three rings 13 of the ring binder mechanism 1 are substantially similar and are each generally circular in shape (e.g., FIG. 2). As illustrated in FIG. 3, the rings 13 each include two generally semi-circular ring members 23*a*, 23*b* formed from a conventional, cylindrical rod of a suitable material (e.g., steel). The ring members 23*a*, 23*b* include free ends 25*a*, 25*b*, respectively, formed to secure the ring members against transverse misalignment (relative to longitudinal axes of the ring members) when they are closed together (see, FIG. 2). The rings 13 could be D-shaped as is known in the art, or otherwise shaped within the scope of this invention. Ring binder mechanisms with ring members formed of different material or having different cross-sectional shapes, for example, oval shapes, or different free end configurations do not depart from the scope of this invention.

As also illustrated in FIG. 3, the ring mechanism 1 includes two substantially identical hinge plates (together broadly defining a "driving mechanism"), designated generally at 27*a*, 27*b*, supporting the ring members 23*a*, 23*b*, respectively. The hinge plates 27*a*, 27*b* are each generally elongate, flat, and rectangular in shape and are each somewhat shorter in length than the housing 11. Three corresponding cutouts 29*a-c* are formed in each of the hinge plates 27*a*, 27*b* along an inner edge margin of the hinge plate. One of the cutouts 29*a* on each of the hinge plates 27*a*, 27*b* includes a down turned tab 82.

Figure 5:
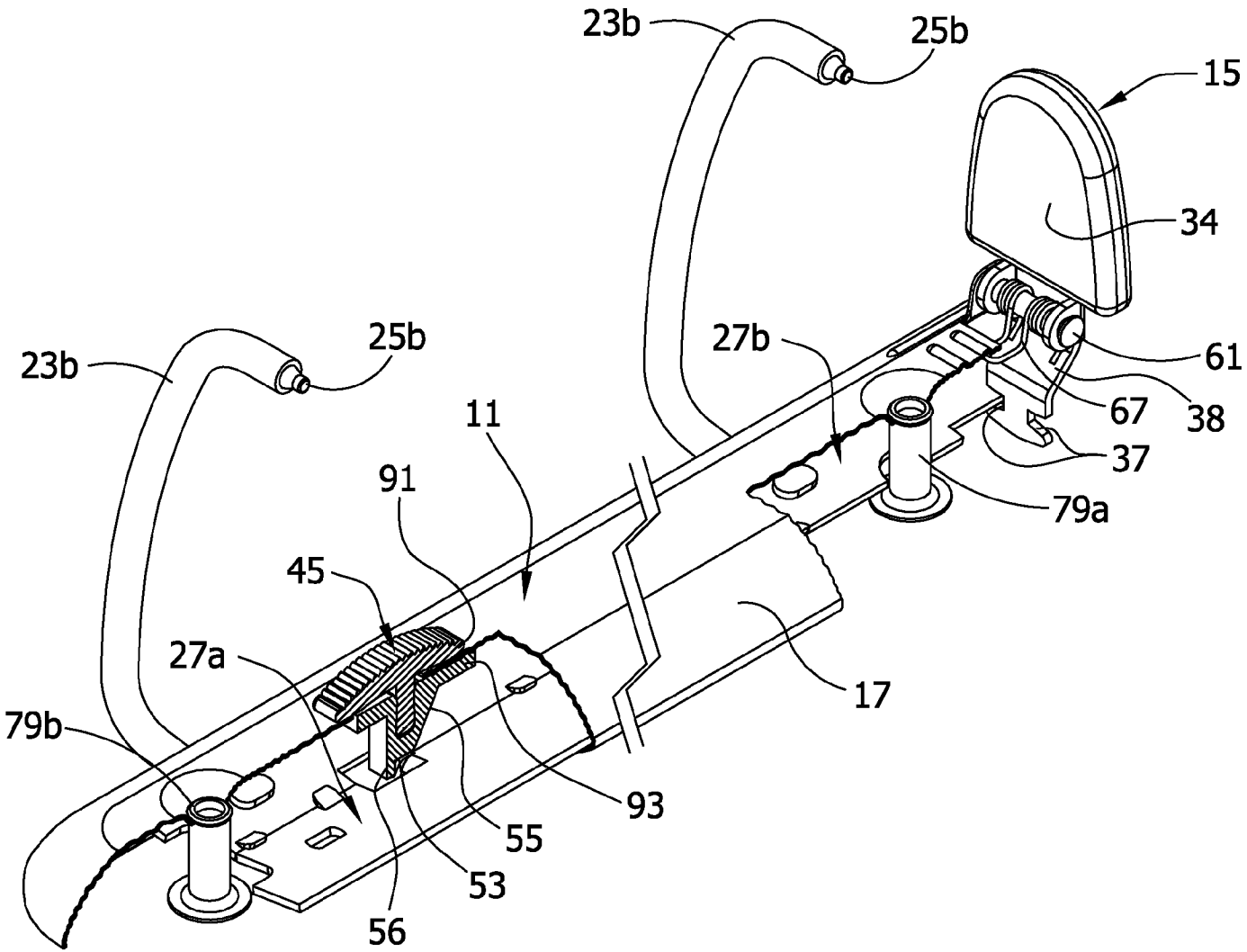
FIG. 5 is an enlarged fragmentary perspective of the ring binder mechanism of FIG. 2 with portions of a housing and a hinge plate broken away and with ring members removed to reveal internal construction.

Referring now to FIGS. 3 and 5, the lever 15 comprises a grip 33, a body 38 (broadly, "a first blocking structure") attached to the grip, a pair of recesses 37 formed in the body, and a pair of mounting ears 35 with openings 36. The grip 33 is broader than the body 38, which facilitates grasping the lever 15 by the grip and applying force to move the lever. In the illustrated configuration, the grip 33 includes a cover 34 but it is understood that the grip can be cover free. The grip 33, body 38, and ears 35, are formed as one-piece but the lever 15 components can be formed separately and assembled together without departing from the scope of the invention. It is understood that the lever 15 can have other configurations without departing from the scope of this invention.

As illustrated in FIG. 5, the lever 15 is pivotally mounted on the housing 11 adjacent the first longitudinal end 10 thereof via a hinge pin 61 extending through the openings 36 in the mounting ears 35 of the lever and the openings 60 in the mounting tabs 59 of the housing. A spring 67 is also mounted on the hinge pin 61 for biasing the lever 15 toward an upright position, which corresponds to the closed position of the ring members 23*a*, 23*b*. Portions of the hinge plates 27*a*, 27*b* adjacent one of the cutouts 29*c* therein are received in the recesses 37 in the lever 15. As a result, part of the body 38 of the lever 15 is disposed below the hinge plates 27*a*, 27*b* and another part of the body 38 is disposed above the hinge plates 27*a*, 27*b*. FIG. 5 illustrates a portion of one of the hinge plates 27*b* being received in one of the recesses 37 of the lever. A ring mechanism having a lever different than the one illustrated and described herein does not depart from the scope of the invention.

The hinge plates 27*a*, 27*b* (FIGS. 4 and 5) are interconnected in parallel arrangement along their inner longitudinal edge margins, forming a central hinge 75 having a pivot axis. This is done in a conventional manner known in the art. As will be described, the hinge plates 27*a*, 27*b* can pivot about the hinge 75 upward and downward. The three cutouts 29*a-c* in each of the two individual hinge plates 27*a*, 27*b* (FIG. 3) align to form three openings also designated 29*a-c* in the interconnected plates (FIG. 4).

The housing 11 supports the interconnected hinge plates 27*a*, 27*b* within the housing. The outer longitudinal edge margins of the hinge plates 27*a*, 27*b* loosely fit behind the bent under rims 21 of the housing 11 for allowing them to move within the rims when the hinge plates pivot. As illustrated in FIG. 4, portions of the hinge plates 27*a*, 27*b* extend into the recesses 37 in the body 38 of the lever 15 so that the lower surfaces of the hinge plates are engagable by the body and the upper surfaces of the hinge plates 27*a*, 27*b* are engagable by the body.

The ring members 23*a*, 23*b* extend through respective cutouts 77 along sides of the housing 11 so that the free ends 25*a*, 25*b* of the ring members can engage above the housing. The ring members 23*a*, 23*b* are rigidly connected to the hinge plates 27*a*, 27*b* as is known in the art and move with the hinge plates when they pivot. Although in the illustrated ring binder mechanism 1 both ring members 23*a*, 23*b* of each ring 13 are each mounted on one of the two hinge plates 27*a*, 27*b* and move with the pivoting movement of the hinge plates, a mechanism in which each ring has one movable ring member and one fixed ring member does not depart from the scope of this invention (e.g., a mechanism in which only one of the ring members of each ring is mounted on a hinge plate with the other ring member mounted, for example, on a housing).

Figure 4:
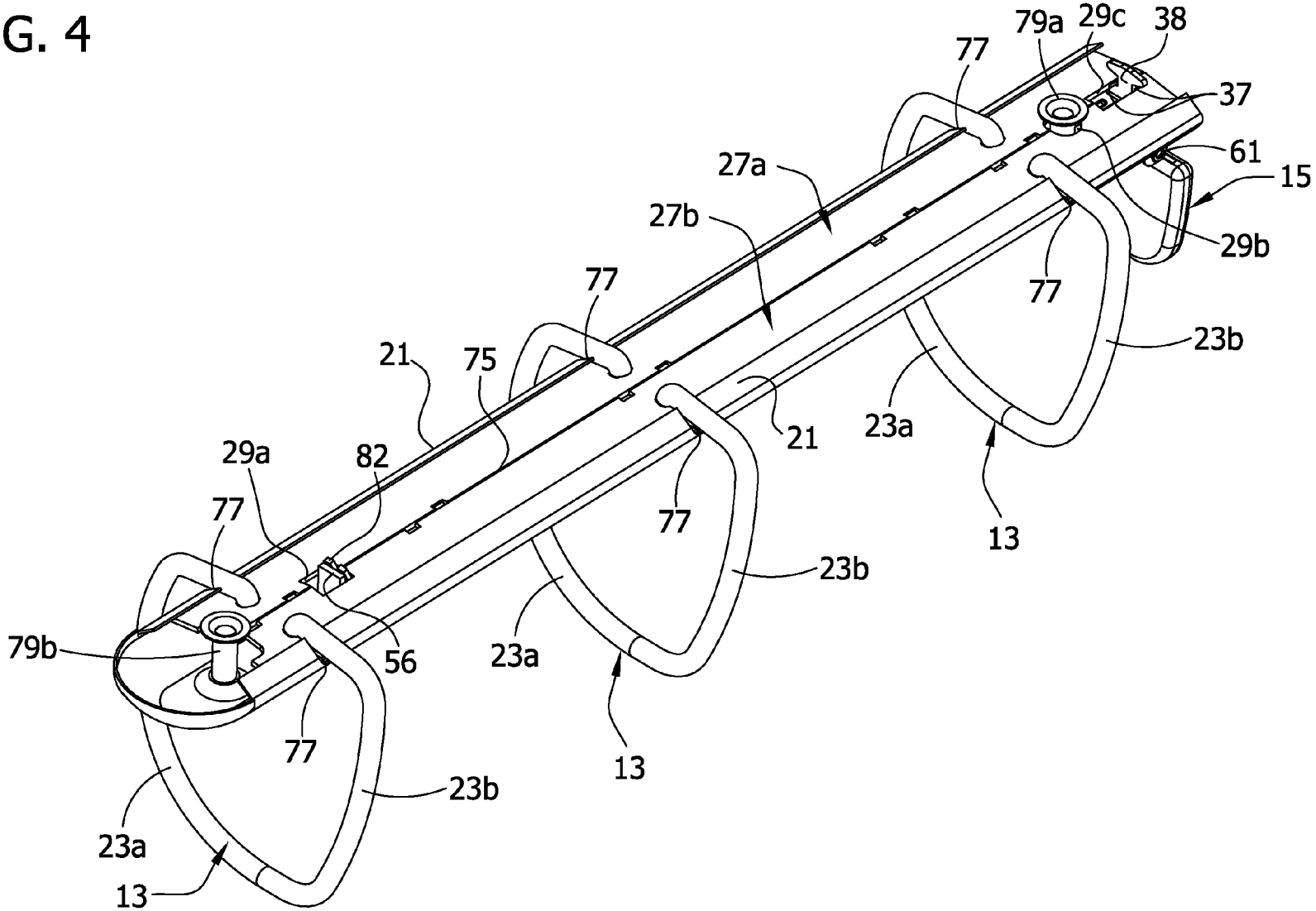
FIG. 4 is a bottom side perspective of the ring binder mechanism.

With reference still to FIG. 4, two mounting posts 79*a*, 79*b* are secured to the illustrated ring mechanism 1 to mount the mechanism on, for example, the notebook 3 (e.g., FIG. 1) in any suitable manner. The posts 79*a*, 79*b* attach to the housing 11 at the openings 81*a*, 81*b* (FIG. 3) in the plateau 17 located toward the longitudinal ends 10, 12 of the housing 11. One of the mounting posts 79*a* (toward the right in FIG. 4) extends through one of the openings 29*b* in the interconnected hinge plates 27*a*, 27*b*.

Referring again to FIGS. 2 and 3, the ring binder mechanism 1 includes an independent blocking device indicated generally at 45 for selectively blocking the ring members 23*a*, 23*b* in their closed position. The blocking device 45 comprises a slide member 91 (also broadly referred to as a "blocking device actuator") and blocking structure 93 (broadly, a "second blocking structure") formed separate from the slide member and operatively connected thereto. As illustrated in FIG. 3, the slide member 91 is generally T-shaped with an arcuate upper surface that is grooved to facilitate digital manipulation by a user's finger(s). As illustrated in FIGS. 3 and 5, the blocking structure 93 includes a narrow, flat bottom 53, an angled forward edge 55, a rearward extension 56, and a recess 57. In the illustrated embodiment, the blocking structure 93 is of a generally wedge shape. However, blocking structure with different shapes, for example, block shapes (e.g., no angled edges or recessed sides), are within the scope of this invention. In the illustrated embodiment, the blocking device 45 is formed of a plastic material by, for example, a mold process but can be formed from other suitable materials. It is also contemplated that the slide member 91 and second blocking structure 93 may be constructed of different materials within the scope of this invention.

The slide member 91 has a snap-fit connection with the blocking structure 93. Specifically, a downward extending tab of the T-shaped slide member 91 extends through the opening 80 in the plateau 17 of the housing 11 and has a snap-fit connection within the recess 57 of the blocking structure 93. The blocking device 45 is slidable relative to the housing 11 between a blocked position wherein the ring members 23*a*, 23*b* are blocked in the closed position and an unblocked position wherein the ring members can be selectively moved from a closed position to an opened position by pivotal movement of the lever 15. In the illustrated configuration, the blocking device 45 is selectively slidable between the blocked and unblocked positions but it is understood that the blocking device can be moved in other ways (e.g., turning, pivoting, etc.).

The housing 11 includes indicia 85 indicating the direction in which the blocking device 45 is slid to move the blocking device to its blocked position. In the illustrated configuration, as illustrated in FIG. 3, the housing 11 includes an arrow and the word "LOCK" to indicate that the blocking device can be slid in a direction indicated by the arrow (i.e., toward the lever) to move the blocking device to its blocked position. It is understood that the housing could include other indicia.

As illustrated in FIG. 2, the blocking device 45 is distally spaced from and operable independently of the lever 15. As mentioned above, the lever 15 is mounted on the housing 11 adjacent the first longitudinal end 10 of the housing. The blocking device 45 is disposed closer to the opposite, second longitudinal end 12 of the housing 11. Thus, the blocking device 45 is disposed adjacent the ring 13 farthest from the lever 15. The lever 15 and blocking device 45 cooperatively lock all of the rings 13 of the ring binder mechanism 1 in the closed position.

Operation of the ring mechanism 1 will now be described with particular reference to FIGS. 5-12. As is known, the hinge plates 27*a*, 27*b* pivot downward and upward relative to the housing 11 and move the ring members 23*a*, 23*b* mounted thereon between a closed position (e.g., FIG. 7) and an opened position (e.g., FIG. 10). The hinge plates 27*a*, 27*b* are wider than the housing 11 when in a co-planar position (180°), so as they pivot through the co-planar position, they deform the housing and create a small spring force in the housing. The housing spring force biases the hinge plates 27*a*, 27*b* to pivot away from the co-planar position, either downward or upward. The ring members 23*a*, 23*b* close when the hinge plates 27*a*, 27*b* pivot downward (i.e., the hinge 75 moves away from the housing 11 (e.g., FIG. 5)). The ring members 23*a*, 23*b* open when the hinge plates 27*a*, 27*b* pivot upward (i.e., the hinge 75 moves toward the housing 11 (e.g., FIG. 11)).

Figure 6:
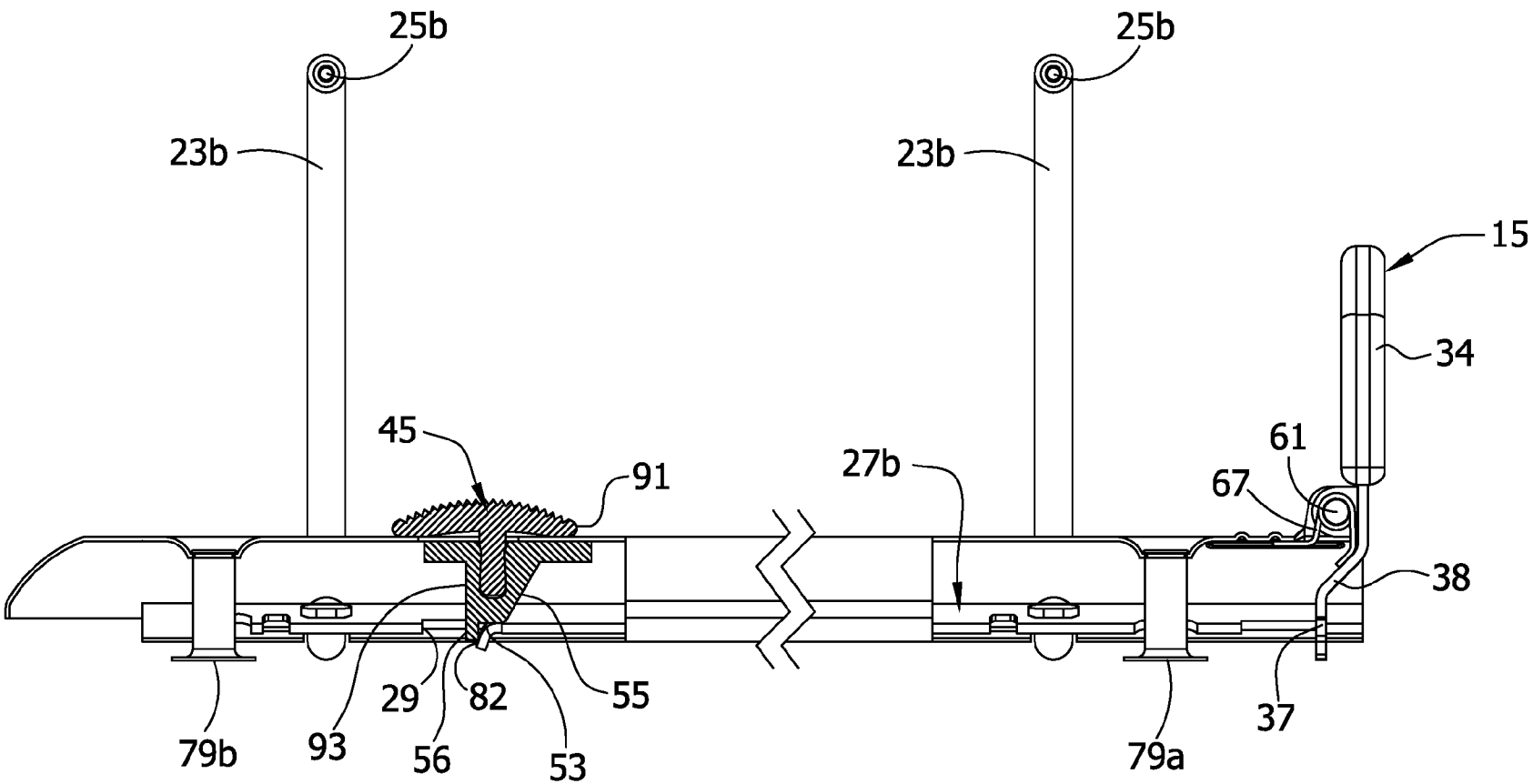
FIG. 6 is a fragmentary side elevation thereof with a hinge plate removed.
Figure 7:
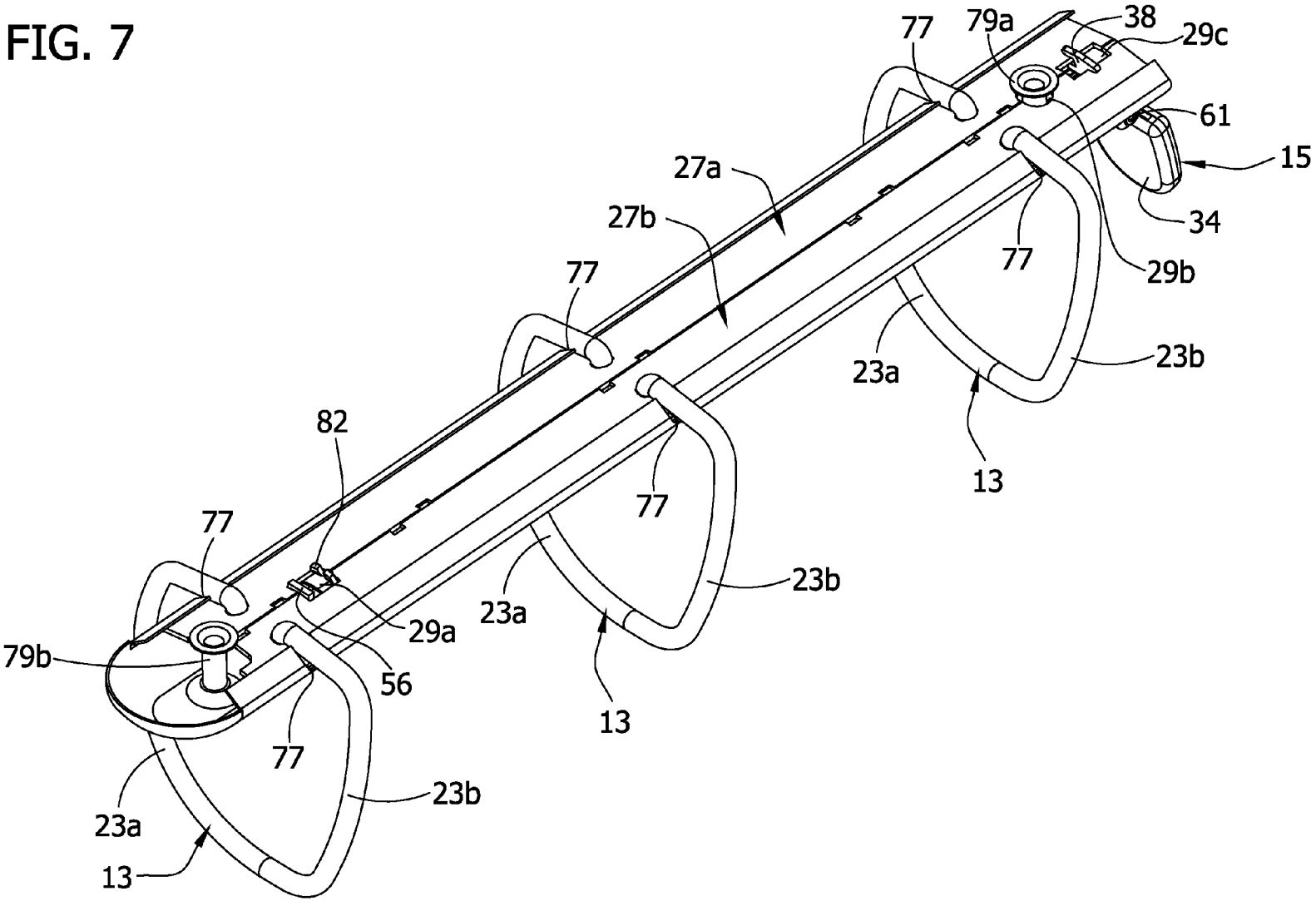
FIG. 7 is similar to FIG. 4 but with the ring binder mechanism at a closed and unblocked position and with a lever in a first pivoted position.

In FIGS. 5-7, the ring mechanism 1 is in a closed and blocked position. The hinge plates 27*a*, 27*b* are hinged downward, away from housing 11, so that the ring members 23*a*, 23*b* of each ring 13 are together in a continuous, circular loop, capable of retaining loose-leaf pages (i.e., closed). The lever 15 is vertical relative to the housing 11 and in an upright position with the body 38 (i.e., the first blocking structure) of the lever engaging the upper surfaces of the hinge plates 27*a*. The body 38 of the lever 15 contacts the upper surfaces of the hinge plates 27*a*, 27*b* and thereby opposes any force tending to pivot the hinge plates 27*a*, 27*b* upward to open the ring members 23*a*, 23*b* (i.e., it secures the ring members closed). In particular, the body 38 (i.e., the first blocking structure) inhibits the ring members 23*a*, 23*b* from being manually pulled apart. However, the lever 15 can still be pivoted, as described in more detail below, to move the rings members 23*a*, 23*b* to their opened position.

In the illustrated configuration, the body 38 of the lever 15 defines the first blocking structure and is formed integral with the lever (i.e., the ring actuator). It is understood, however, that the first blocking structure can be formed separate from the lever 15 but operatively connected thereto. For example, the first blocking structure can be positioned closer to ring members 23*a*, 23*b* nearest the lever 15. It is also understood that the first blocking structure can have configurations different than those illustrated herein.

As illustrated in FIG. 5, the blocking device 45 is positioned adjacent one of the openings 29*a* in the hinge plates 27*a*, 27*b* and generally aligned with and above the hinge 75. The flat bottom surface 53 of the blocking structure 93 rests on the upper surfaces of the hinge plates 27*a*, 27*b* and the rearward extension 56 extends through the opening 29*a* adjacent the tabs 82 of the hinge plates. The blocking structure 93 of the blocking device 45 opposes any force tending to pivot the hinge plates 27*a*, 27*b* upward to open the ring members 23*a*, 23*b* (i.e., it secures the ring members closed). The blocking structure 93 (and the blocking device actuator, i.e., slide member 91, to which the second blocking structure is operatively connected) is spaced from and operates independent of at least the first blocking structure and more suitably independent of the lever 15, i.e., the ring actuator, as well.

As a result, the lever 15 and blocking device 45 cooperatively, but independently, oppose forces tending to pivot the hinge plates 27*a*, 27*b* upward to open the ring members 23*a*, 23*b*. That is, the lever 15 and blocking device 45 cooperatively inhibit the ring members 23*a*, 23*b* from being pulled apart.

Figure 8:
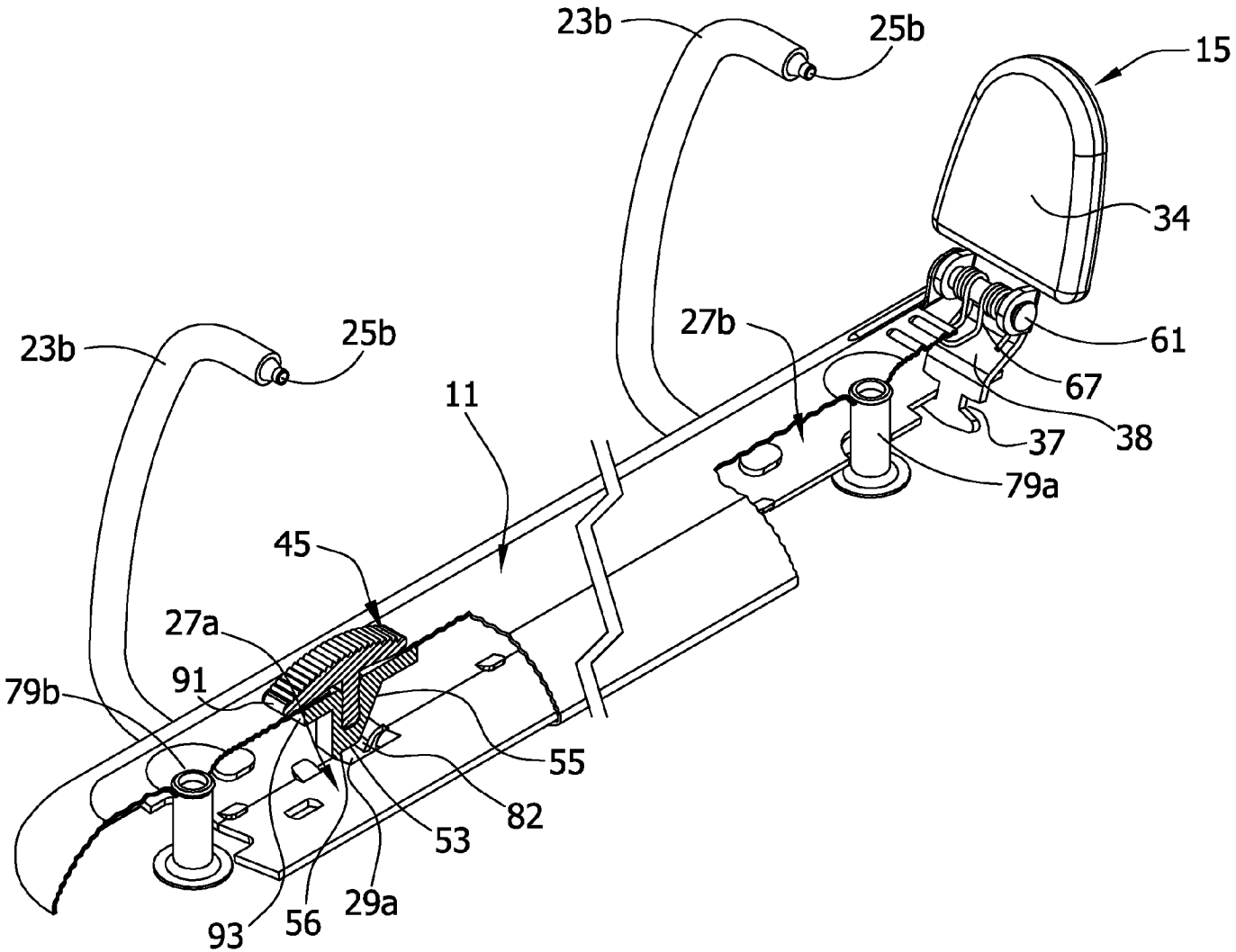
FIG. 8 is an enlarged fragmentary perspective of the ring mechanism of FIG. 7 with portions of the housing and one of the hinge plates broken away and with ring members removed to reveal internal construction.
Figure 9:
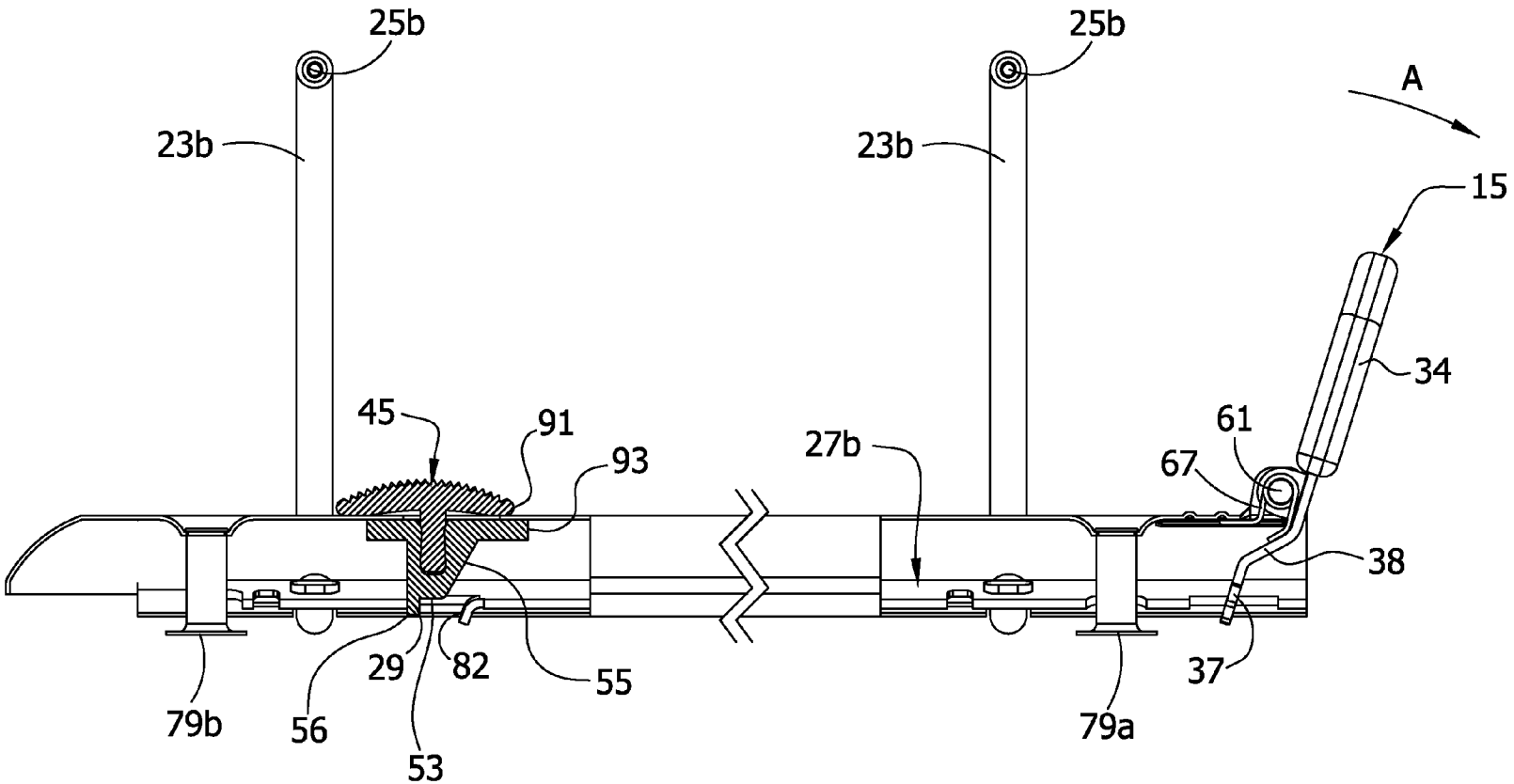
FIG. 9 is a fragmentary side elevation thereof with one of the hinge plates removed.
Figure 10:
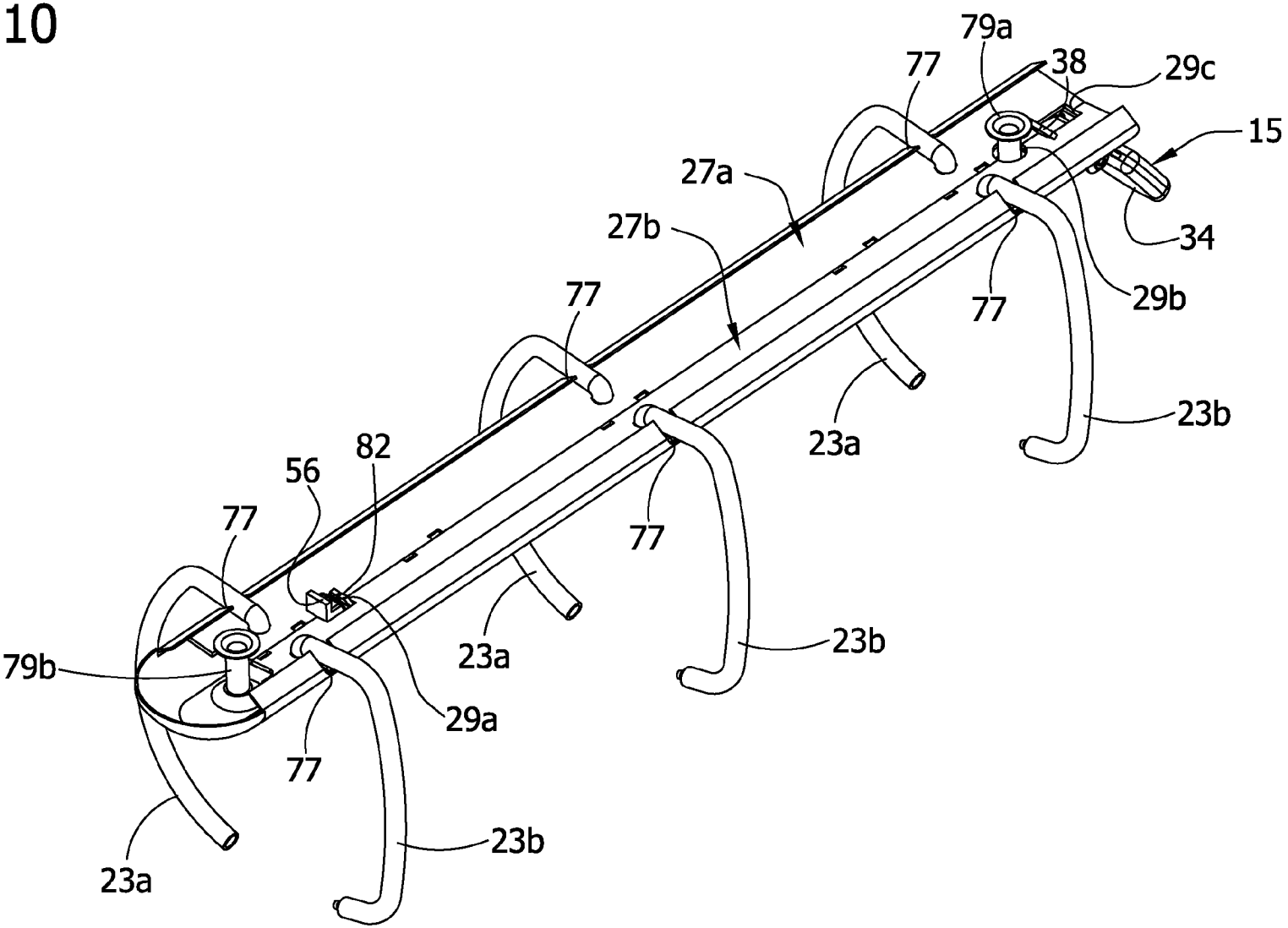
FIG. 10 is similar to FIG. 7 but with the ring binder mechanism at an opened position and with the lever in a second pivoted position.

To unblock the ring mechanism 1 and open the ring members 23*a*, 23*b*, an operator slides the blocking device 45 with respect to the housing 11. In the illustrated configuration, the operator slides the slide member 91 of the blocking device 45 toward the closed end 12 of the housing 11 (i.e., to the left in FIG. 5). Sliding the slide member 91 in this direction moves the blocking structure 93 into registration over the opening 29*a* in the hinge plates 27*a*, 27*b* (FIGS. 7-9). The operator then applies force to the grip 33 of the lever 15 and pivots it clockwise (arrow A as viewed in FIG. 9). The body 38 of the lever 15, and more particularly the portion of the body below the recesses 37, is moved into engagement with the lower surfaces of the hinge plates 27*a*, 27*b*. The lever 15, as illustrated in FIGS. 8-10, is in a first actuated position. At this instant in the opening movement, if the lever 15 is released before the hinge plates 27*a*, 27*b* pivot upward through their co-planar position (i.e., before the ring members 23*a*, 23*b* open), the spring 67 will automatically push the lever 15 back to the vertical position (i.e., the upright position).

Figure 11:
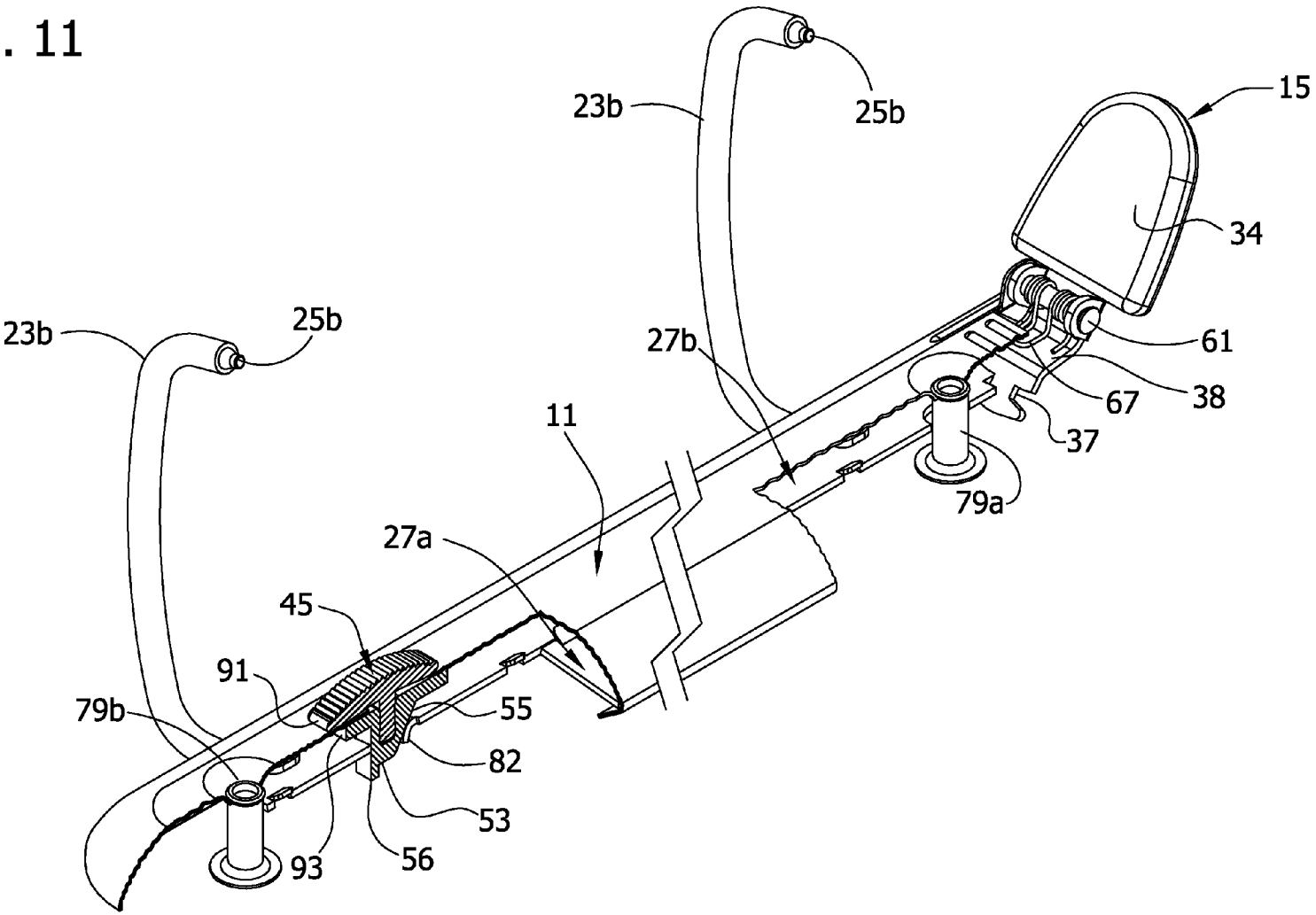
FIG. 11 is an enlarged fragmentary perspective of the ring mechanism of FIG. 10 with portions of the housing and one of the hinge plates broken away and with ring members removed to reveal internal construction.
Figure 12:
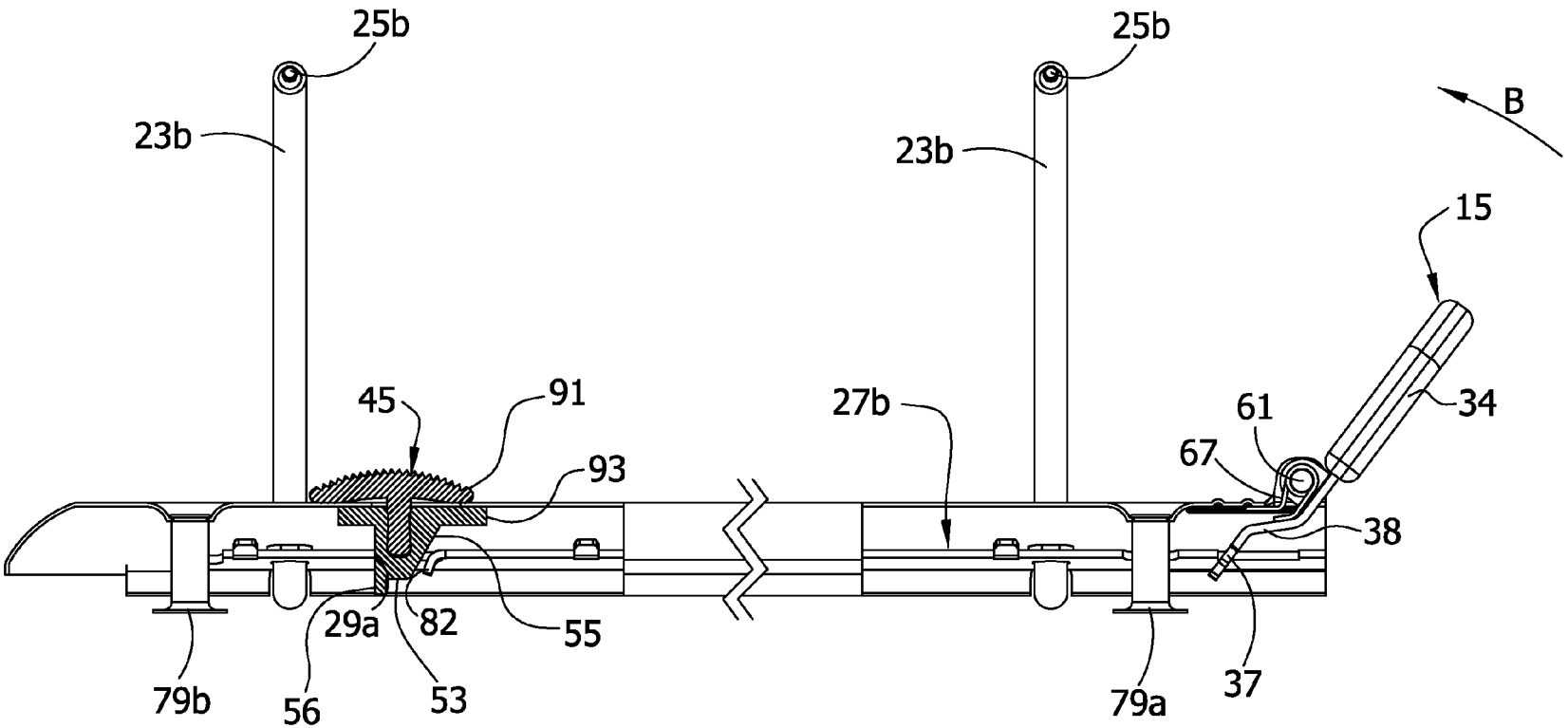
FIG. 12 is a fragmentary side elevation thereof with one of the hinge plates removed.

Continued opening movement of the lever 15 causes the body 38 to conjointly pivot the interconnected hinge plates 27*a*, 27*b* upward over the blocking structure 93 of the blocking device 45 at the openings 29*a* (FIGS. 10-12). Once the hinge plates 27*a*, 27*b* pass through the co-planar position, the housing spring force pushes them upward, opening the ring members 23*a*, 23*b*. The lever 15 can be released. The lever 15 is again relaxed, this time in a second pivoted position.

To close the ring members 23*a*, 23*b* and return the mechanism 1 to the locked position, an operator can pivot the lever 15 upward and inward as illustrated in FIG. 12 (counterclockwise as shown by arrow B in FIG. 12). The portion of the body 38 of the lever 15 above the recesses 37 begins pushing downward on the upper surfaces of the hinge plates 27*a*, 27*b*, but the spring force of the housing 11 resists the initial hinge plate movement. As the lever 15 continues to pivot, the body 38 of the lever 15 causes the interconnected hinge plates 27*a*, 27*b* to pivot downward. Once the hinge plates 27*a*, 27*b* pass through the co-planar position, the housing 11 spring force pushes them downward, closing the ring members 23*a*, 23*b*. The operator can then slide the blocking device 45 using the slide member 91 back to its blocked position with the blocking structure 93 out of alignment with the opening 29*a*. The lever 15 is again in the upright position, and the blocking device 45 is behind the hinge plates 27*a*, 27*b*, blocking pivoting motion of the hinge plates.

In the illustrated mechanism 1, the ring members 23*a*, 23*b* can also be closed by manually pushing the free ends 25*a*, 25*b* of the ring members together.

Components of ring binder mechanisms of the embodiments described and illustrated herein are made of a suitable rigid material, such as a metal (e.g. steel). But mechanisms having components made of a nonmetallic material, specifically including a plastic, do not depart from the scope of this invention.

When introducing elements of the ring binder mechanisms herein, the articles "a", "an", "the" and "said" are intended to mean that there are one or more of the elements. The terms "comprising", "including" and "having" and variations thereof are intended to be inclusive and mean that there may be additional elements other than the listed elements. Moreover, the use of "forward" and "rearward" and variations of these terms, or the use of other directional and orientation terms, is made for convenience, but does not require any particular orientation of the components.

As various changes could be made in the above without departing from the scope of the invention, it is intended that all matter contained in the above description and illustrated in the accompanying drawings shall be interpreted as illustrative and not in a limiting sense.

What is claimed is:

1. A ring binder mechanism for holding loose-leaf pages, the mechanism comprising:

a housing;

a driving mechanism supported by the housing for movement relative to the housing;

rings for holding the0 loose-leaf pages, each ring including a first ring member and a second ring member, the first ring member being operatively connected to the driving mechanism for movement relative to the second ring member between a closed position and an opened position of said ring members, in the closed position the two ring members forming a substantially continuous, closed loop for allowing loose-leaf pages retained by the rings to be moved along the rings from one ring member to the other, and in the opened position the two ring members forming a discontinuous, open loop for adding or removing loose-leaf pages from the rings;

a ring actuator positionable relative to the housing and operatively connected to the driving mechanism for moving the ring members between their closed and opened positions;

a first blocking structure for blocking the ring members in their closed position against movement to their open position, the first blocking structure being positionable relative to the housing between a blocking position in which movement of the ring members toward their opened position is inhibited by the first blocking structure and an unblocking position in which the first blocking structure allows the ring members to move to their opened position, said first blocking structure being operatively connected to the ring actuator so the ring actuator moves the first blocking structure between its blocking and unblocking positions when the ring actuator is used to move the ring members between their closed and opened positions; and a blocking device including a second blocking structure for blocking the ring members in their closed position against movement to their opened position, the second blocking structure being positionable relative to the housing between a blocking position in which the ring members are inhibited by the second blocking structure against movement toward their opened position and an unblocking position in which the second blocking structure allows the ring members to be moved from their closed position to their opened position by positioning of the actuator, said second blocking device being operable independent of the ring actuator.

2. The ring binder mechanism as set forth in claim 1 wherein the blocking device is spaced from the actuator.

3. The ring binder mechanism as set forth in claim 2 wherein the housing has longitudinally opposite ends, the ring actuator being mounted on the housing adjacent one longitudinal end of the housing, said blocking device being disposed nearer to the opposite longitudinal end of the housing than to said one longitudinal end of the housing.

4. The ring binder mechanism as set forth in claim 3 wherein the mechanism has three rings spaced longitudinally from each other along said mechanism.

5. The ring binder mechanism as set forth in claim 4 wherein the blocking device is disposed longitudinally adjacent the ring farthest from the actuator.

6. The ring binder mechanism as set forth in claim 1 wherein the blocking device is selectively slidable relative to the housing between the blocking and unblocking positions.

7. The ring binder mechanism as set forth in claim 6 wherein the housing has indicia indicating the direction in which the blocking device is slid to move the blocking device to at least one of the blocking and unblocking positions.

8. The ring binder mechanism as set forth in claim 6 wherein said blocking device includes an arcuate upper surface.

9. The ring binder mechanism as set forth in claim 1 wherein the driving mechanism comprises a pair of hinge plates.

10. The ring binder mechanism as set forth in claim 9 wherein a portion of the blocking device is disposed between the housing and hinge plates in the blocking position of the blocking device to thereby inhibit movement of the hinge plates with respect to the housing.

11. The ring binder mechanism as set forth in claim 10 wherein the hinge plates together have therein an opening, the blocking device being aligned with said opening in the unblocked position of the blocking device.

12. The ring binder mechanism as set forth in claim 1 wherein the blocking device, the blocking device further comprises a slide member formed separate from the second blocking structure and operatively connected thereto for positioning the second blocking structure conjointly with the slide member relative to the housing.

13. The ring binder mechanism as set forth in claim 12 wherein the slide member has a snap-fit connection with the second blocking structure.

14. The ring binder mechanism as set forth in claim 1 wherein the housing has a plateau having an aperture therein, the blocking device extending through the aperture.

15. The ring binder mechanism as set forth in claim 1 wherein the ring actuator comprises a lever.

16. The ring binder mechanism as set forth in claim 15 wherein the first blocking structure is part of the lever.

17. The ring binder mechanism as set forth in claim 1 in combination with a cover, the ring binder mechanism being mounted on the cover, the cover being hinged for movement to selectively cover and expose loose-leaf pages when retained on the ring binder mechanism.

* * * * *

UNITED STATES PATENT AND TRADEMARK OFFICE

CERTIFICATE OF CORRECTION

PATENT NO. : 7,654,764 B2
APPLICATION NO. : 11/749290
DATED : February 2, 2010
INVENTOR(S) : To It is certified that error appears in the above-identified patent and that said Letters Patent is hereby corrected as shown below:

Column 7, Claim 1, Line 65: "the0 loose-leaf pages," should read -- the loose-leaf pages, --.

Signed and Sealed this

Thirteenth Day of April, 2010

David J. Kappos

David J. Kappos
*Director of the United States Patent and Trademark Office*